US006503679B2

(12) United States Patent
Aoki et al.

(10) Patent No.: US 6,503,679 B2
(45) Date of Patent: Jan. 7, 2003

(54) COLOR TONER FOR DEVELOPING AN ELECTROSTATIC IMAGE

(75) Inventors: Megumi Aoki, Itami (JP); Masahide Inoue, Suita (JP); Yoshihiro Mikuriya, Nishinomiya (JP); Masayuki Hagi, Mino (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/920,716

(22) Filed: Aug. 3, 2001

(65) Prior Publication Data

US 2002/0042013 A1 Apr. 11, 2002

(30) Foreign Application Priority Data

Aug. 8, 2000 (JP) ..... 2000-239725

(51) Int. Cl.[7] ..... G03G 9/087

(52) U.S. Cl. ..... 430/108.8; 430/109.1; 430/109.4; 430/111.4

(58) Field of Search ..... 430/109.4, 108.8, 430/109.1, 111.4

(56) References Cited

U.S. PATENT DOCUMENTS 4,913,991 A * 4/1990 Chiba et al. ..... 430/111.4
4,968,574 A 11/1990 Morita et al.
5,279,915 A * 1/1994 Hagiwara et al. ..... 430/111.4
5,362,593 A * 11/1994 Inoue et al. ..... 430/111.4
5,514,511 A 5/1996 Iwamoto et al.
5,571,652 A * 11/1996 Asano et al. ..... 430/111.4
5,707,771 A 1/1998 Matsunaga
5,753,399 A 5/1998 Hayase et al.
5,766,816 A 6/1998 Nagase et al.
5,840,457 A 11/1998 Urawa et al.
5,955,234 A * 9/1999 Matsunaga et al. ..... 430/111.4
6,002,903 A 12/1999 Hayase et al.

FOREIGN PATENT DOCUMENTS

JP 63-174061 7/1988
JP 63-174062 7/1988
JP 63-174063 7/1988

* cited by examiner

*Primary Examiner*—Christopher Rodee
(74) *Attorney, Agent, or Firm*—Burns, Doane, Swecker & Mathis, LLP

(57) ABSTRACT

The present invention provides a color toner for developing an electrostatic image having excellent light transmission for OHP and fixing efficiency, said color toner effectively preventing a low temperature offset and a high temperature offset when it is applied to a fixing device whose coating weight of an oil is reduced. The color toner is characterized in that (i) it comprises a binding resin and a colorant, (ii) its storage elastic modulus at 90° C. ($G'_{90}$) is not more than $6\times10^4$ Pa, (iii) its storage elastic modulus at 140° C. ($G'_{140}$) is not less than $5\times10^2$ Pa, (iv) a temperature showing a maximum value of δ in tanδ=G"/G' (wherein G' is a storage elastic modulus of the color toner, and G" is a loss elastic modulus of the color toner) exists in the range of 90–120° C., and (v) the maximum value of δ is not less than 60°.

19 Claims, 1 Drawing Sheet

COLOR TONER FOR DEVELOPING AN ELECTROSTATIC IMAGE

This application is based on an application No. 239725/2000 filed in Japan, the contents of which are hereby incorporated by reference.

BACKGROUND OF THE INVENTION

1. Field of the Invention

The present invention relates to a color toner for developing an electrostatic image.

2. Description of the Related Art

In an electrophotograph process, it is a general manner to form a fixed image by way of plural processes wherein (i) a latent image is electrostatically formed on a photosensitive member comprising a photoconductive material by various means, (ii) the latent image is developed by using a toner, (iii) the toner image on the photoconductive member is transferred to a member to be transferred (e.g. paper and the like) by way of an intermediate transfer member or by a direct manner, and then (iv) the transferred image is fixed on the member to be transferred. Recently, the electrophotographic process has been extensively utilized in not only a copying machine but also a printer since the machinery and tools have been developed and the communication networks are expanded in an information-oriented society, and therefore miniaturization, lightening, speeding up and high dependability of the apparatuses have strictly been required.

In case of a color electrophotography, high image quality and high color development are required of the formed image. In order to obtain the image having high image quality and high color development, the toner must sufficiently be melted to form the fixed image having a smooth surface from viewpoints of light transmission (particularly light transmission for OHP), glossiness and the like. For this reason, a fixing process is especially important in the electrophotographic process.

As a contact-type fixing method which has formerly been used widely as a fixing method, a method wherein heat and pressure are applied at the time of fixing (hereinafter referred to as heat-contact bonding method) has generally been employed. In the case of the heat-contact bonding method, it is known that a heat efficiency is extremely excellent and the fixing can quickly be carried out, and particularly said method is very effective for a high-speed electrophotographic copying machine, because a surface of a fixing member is contacted with the toner on the member to be transferred under pressure. However, the aforementioned heat-contact bonding method causes a problematic phenomenon that a part of the toner image is adhered to the surface of the fixing member and is transferred to nonimage part of the member to be transferred since the toner image is contacted in a heated and melted state with the surface of the fixing member under pressure (a high temperature offset). In particular, it is necessary for a fixing of the color toner to apply a sufficient heat and pressure to the color toner to afford it a higher flowability in comparison with a fixing a black-and-white toner since it is necessary in the former to melt and mix the plural colored toners. Therefore it has been more difficult to release the toner image from the fixing member in the former in comparison with a releasability of the latter because it is necessary to release the melted thicker layer formed by superposing the plural colored toners without causing the high temperature offset.

Accordingly, a method wherein silicone oil and the like are coated on the surface of the fixing member as a liquid for preventing the high temperature offset has been employed as a convenient method for preventing the adhesion of the toners on the surface of the fixing member. However, and oil adhesion after the fixing to the member to be transferred and the image has been come into question since it is necessary to use a relatively large amount of the oil in order to prevent the high temperature offset by the oil only at the time of forming the color image. Furthermore, in the case where the oil is employed, there are problems that (i) a fixing apparatus requires a tank for storing the oil and the like, (ii) the tank makes the miniaturization of the apparatus difficult, (iii) a supplement of the oil is troublesome, and (iv) a low-costing is restricted.

In U.S. Pat. No. 4,968,574, a black-and-white toner is disclosed which exhibits an excellent oilless fixing aptitude which is caused by a combination effect of a wax and a resin having a wide molecular weight distribution, said resin comprising a low molecular weight component and a high molecular weight component. According to this technique, the toner image on the member to be transferred is remained as it is in order to prevent the high temperature offset by a rubber elasticity which is attributable to the high molecular weight component. However, when this technique is applied to the fixing of the color image, there is a problem that a glossiness of the fixed image obtained becomes lower, and a color development of the color image is reduced. In addition, the aforementioned problem of the high temperature offset cannot be solved completely by this technique since there are instances where the color image is formed by a superposition of three or four toner layers.

The Japanese Patent Publication (KOKAI) Nos. 174061/1988, 174062/1988 and 174063/1988 disclose the techniques wherein a resin prepared by using isocyanate, a resin having atom group of —NHCO— in the molecule, and a low molecular crystalline resin having a strong cohesive energy (amide wax) are employed respectively. According to these techniques, although the fixing at low temperature can be achieved, the offset resistance is insufficient. Furthermore, although the effect of preventing the offset can be brought about by a permeation of the molted toner into paper, a uniform image having high density cannot be obtained.

SUMMARY OF THE INVENTION

The present invention has been made in view of the aforementioned situation. The object of the present invention is to provide a color toner for developing an electrostatic image having excellent fixing efficiency, said toner effectively preventing the low temperature offset and the high temperature offset when it is applied to the fixing device whose coating weight of an oil is reduced. Another object of the present invention is to provide a color toner for developing an electrostatic image having excellent fixing efficiency, said toner having a relatively wide and low temperature range which does not bring about the low temperature offset and the high temperature offset.

The present invention relates to a color toner characterized in that (i) it comprises a binding resin and a colorant, (ii) its storage elastic modulus at 90° C. ($G'_{90}$) is not more than $6\times10^4$ Pa, (iii) its storage elastic modulus at 140° C. ($G'_{140}$) is not less than $5\times10^2$ Pa, (iv) a temperature showing a maximum value of $\delta$ in $\tan\delta=G''/G'$ (wherein G' is a storage elastic modulus of the color toner, and G" is a loss elastic modulus of the color toner) exists in the range of 90–120° C., and (v) the maximum value of $\delta$ is not less than 60°.

The present inventors have paid our attention to a behavior of the toner at the specified temperature range, and have found that the aforesaid objects can be achieved by increasing an elasticity of the toner at the time of melting (fixing) the toner and by decreasing the elasticity of the toner at a relatively low temperature.

DETAILED DESCRIPTION OF THE INVENTION

Figure 1:
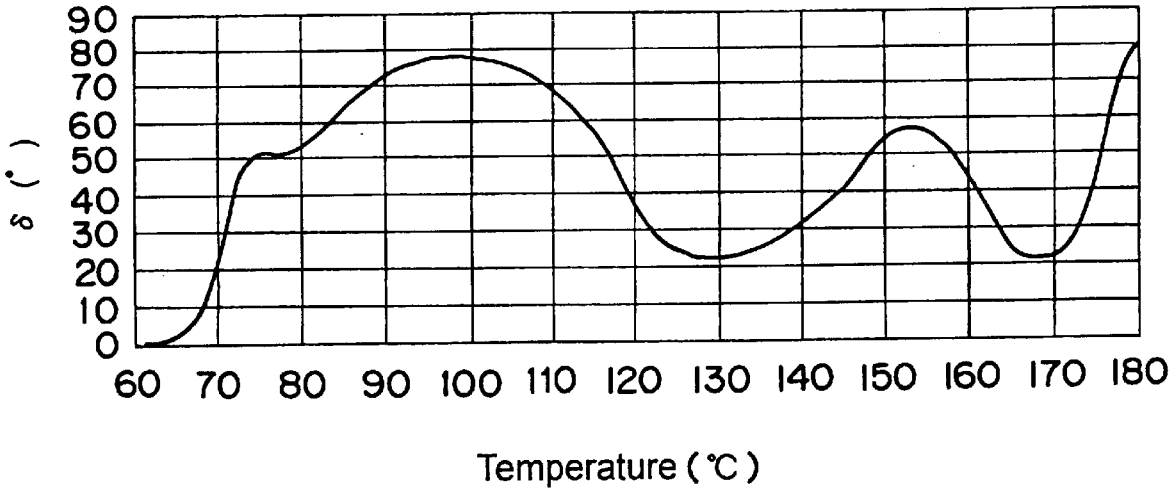
FIG. 1 is a graph which shows a viscoelasticity of one example of the toners according to the present invention.

The storage elastic modulus at 90° C. ($G'_{90}$) of the color toner according to the present invention is not more than $6\times10^4$ Pa, preferably $3\times10^4$–$6\times^4$ Pa, more preferably $4\times10^4$–$6\times10^4$ Pa, most preferably $5\times10^4$–$6\times10^4$ Pa. The storage elastic modulus at 140° C. ($G'_{140}$)of the color toner according to the present invention is not less than $5\times10^2$ Pa, preferably $5\times10^2$–$1\times10^5$ Pa, more preferably $5\times10^2$–$1\times10^4$ Pa, most preferably $5\times10^2$–$1\times10^3$ Pa.

The storage elastic modulus (G') is an indication which indicates a behavioral property of a material. The larger said value is, the stronger the tendency of said material (toner) to behave elastically is. In the present specification, the value of G' is employed, said value being measured by means of the apparatus for measuring a viscoelasticity (Rheometer (stress-controlling type) manufactured by Rheologica) under the following conditions:

Measuring fixture: parallel plates whose diameter is 20 mm
Measuring frequency: 0.1 Hz
Measuring strain: 5% (maximum)
Measuring temperature: 60–180° C.
Measuring heating rate: 2° C./min
Gap: 1 mm When $G'_{90}$ is more than $6\times10^4$ Pa, the low temperature offset is easy to occur since the fixing at low temperature is not excellent because of a strong elasticity of the toner. For this reason, the running cost becomes worse since it is necessary to set the fixing temperature to a relatively high temperature which requires a relatively large energy for the fixing. When $G'_{140}$ is less than $5\times10^2$ Pa, the high temperature offset is easy to occur because of low elasticity of the toner.

In case of the toner according to the present invention, a value of δ shows a specified maximum in a graph between δ (ordinate axis) and temperature (abscissa axis) which is depicted according to the following equation:

$$\tan\delta = G''/G'$$

wherein G' is a storage elastic modulus of the toner, and G" is a loss elastic modulus of the toner. The maximum of δ will be explained with reference to FIG. 1 which shows a graph between δ (ordinate axis) and temperature (abscissa axis) of one example of the toners according to the present invention. The temperature showing the maximum of δ of the toner exists in the range of 90–120° C., preferably 90–110° C., more preferably 95–105° C., and said maximum is not less than 60°, preferably not less than 60° and not more than 90°, more preferably 60–85°, most preferably 60–80°.

The value of tanδ is an indication which shows a behavioral property of a material. The smaller the value of δ is, the smaller the value of tanδ, which means that the material (toner) has a strong tendency to bahave elastically. On the other hand, the larger the value of δ is, the larger the value of tanδ is, which means that the material (toner) has a strong tendency to behave viscously. Furthermore, an existence of the maximum of δ means that the viscoelasticity of the material (toner) changes drastically before and behind the temperature at which the maximum of δ appears (hereinafter referred to as maximum temperature). Detailedly speaking, the material has an increasing tendency as a whole to behave viscously before the maximum temperature, and said tendency changes completely at the maximum temperature, i.e. the material has an increasing tendency as a whole to behave elastically behind the maximum temperature.

When the maximum temperature exists in the temperature range of less than 90° C., the low temperature offset is easy to occur since the fixing at low temperature is not excellent because of an increasing elasticity of the toner at low temperature. On the other hand, when the maximum temperature exists in the temperature range of more than 120° C., the high temperature offset is easy to occur and the temperature range of the fixing becomes narrower since it is difficult to increase the elasticity of the toner at the time of fixing. Furthermore, when the maximum of δ is less than 60°, the low temperature offset is apt to occur since it is difficult to sufficiently increase the viscosity of the toner at the time of fixing.

A graph between δ (ordinate axis) and temperature (abscissa axis) can be measured by the same method as the measuring method of the aforementioned G'.

Although the toner according to the present invention may comprise any components for toner and may be prepared by any publicly known methods provided that the toner having the aforementioned viscoelasticity, the toner of the present invention can effectively be prepared by employing the aftermentioned components for toner and preparation methods.

The toner according to the present invention comprises at least a binder resin and a colorant, and, if necessary, may comprise a charge-controlling agent, a release agent, magnetic particles, inorganic fine particles, organic fine particles, a pulverizing assistant and a wax dispersant.

The binder resin used in the present invention is not specifically limited. Synthetic resins and natural resins which are known in the field of toner can be employed in the present invention. The following resins can be exemplified: polyester resins, styrene resins, acrylic resins, styrene-acrylic resins, silicone resins, epoxy resins, diene resins, phenolic resins, terpene resins, coumarin resins, amide resins, amide-imide resins, butyral resins, urethane resins, ethylene-vinyl acetate resins, petroleum resins, polycarbonate resins, polyether resins, polyacrylonitrile resins, polyacrylate resins and the like. These binder resins may be employed independently or in a mixture. From a viewpoint of a fixability, it is preferable to use polyester resins.

In the case where any of the aforesaid binder resins is used, the viscoelasticity of the toner can be controlled by employing the crystalline resin individually or combinedly with a noncrystalline resin and by adjusting its or their blending amount. Namely, when the blending amount of the crystalline resin is increased, $G'_{140}$ is generally increased, and the maximum of δ is also increased. On the other hand, when the blending amount of the crystalline resin is decreased, $G'_{140}$ is generally decreased, and the maximum of δ is also decreased.

The crystalline resin is a resin which can bring about its crystallization with an increase of temperature. The crystallization is a phenomenon wherein, when a temperature of the resin is increased, a degree of freedom of a polymer chain which constitutes the resin is increased, and an arrangement of at least a part of the polymer chain is rearranged in such a way that said part has a three-dimensional regularity to some extent, and G' of the resin is increased. Although it is known that such a crystallization is easy to occur the less a heating rate of the resin is, it is enough for the present invention that the crystallization will occur at the heating rate of 2° C./min. It is thinkable that the viscoelasticity of the toner can be controlled by increasing or decreasing the blending amount of the crystalline resin since G' of the crystalline resin is increased by the aforesaid crystallization. Although the crystalline resin may or may not comprise a crystalline phase in the toner in so far as the aforesaid crystallization can be occurred, it is preferable that said resin comprises the crystalline phase, because the aforesaid crystallization is easy to occur when the resin comprises the crystalline phase which is a phase wherein a crystal lattice having the three-dimensional regularity is formed by a gathering of the whole or a part of the polymer chain.

Meanwhile, the noncrystalline resin is a resin which does not bring about the aforementioned crystallization with an increase of temperature.

For example, in the case where crystalline polyester resin and noncrystalline polyester resin are employed, the former can be obtained by a publicly known polymerization technique wherein a mixture of carboxylic acid components and alcohol components comprising at least a monomer which is easy to bring about the aforementioned crystallization (hereinafter referred to as crystalline monomer), i.e. a crystalline alcohol component and/or crystalline carboxylic acid component, is heated with stirring under the atmosphere of nitrogen in the presence of a polymerization initiator. Although a using amount of the crystalline monomer based on a total amount of the monomers to be used is not specifically restricted in so far as the obtained resin can bring about the aforementioned crystallization, a desirable using amount of the crystalline monomer is usually 10–60 mol %, preferably 10–40 mol %. From a viewpoint of an environmental factor, it is preferable to adjust an acid value of the crystalline polyester resin to 0–35 KOHmg/g, preferably 0–15 KOHmg/g.

The aforementioned monomer is not specifically restricted in so far as it is a divalent monomer having a linear structure whose linearity is such that the aforesaid crystallization can occur in a site of the polymer chain, said site including said monomer. As the crystalline monomers (crystalline alcohol component and crystalline carboxylic acid component), a monomer having reactive groups on its both ends is exemplified, said reactive groups being linked with one or more groups selected from a class consisting of alkylene groups having no substituent and divalent cyclic saturated hydrocarbon groups.

As the preferred crystalline alcohol components, for example, the compounds represented by the general formulae (1) and (2) are mentioned.

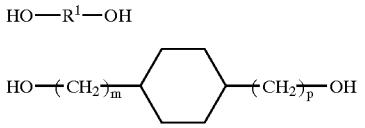

(1)

(2)

In the formula (1), $R^1$ is an alkylene group whose carbon atom number is 1–8, preferably 2–6. As the preferred compounds (1), ethylene glycol, 1,3-propanediol, 1,4-butanediol, 1,5-pentanediol, 1,6-hexanediol and the like are exemplified. Ethylene glycol is more preferable.

In the formula (2), m and p are independently integer of 0–5, preferably 0–2. As the preferred compounds (2), 1,4-cyclohexanedimethanol, 1,4-cyclohexanediethanol, 1,4-dihydroxycyclohexane and the like are exemplified. 1,4-Cyclohexanedimethanol is more preferable.

As the preferred crystalline carboxylic acid components, the compounds represented by the general formulae (3) and (4), their anhydrides or lower alkyl esters and the like are exemplified.

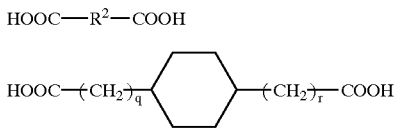

(3)

(4)

In the formula (3), $R^2$ is and alkylene group whose carbon atom number is 1–8, preferably 2–6. The preferred compounds (3) are malonic acid, succinic acid, glutaric acid, adipic acid, pimeric acid, suberic acid, azelaic acid, sebacic acid and the like.

In the formula (4), q and r are independently integer of 0–5, preferably 0–2. As the preferred compounds (4), 1,4-cyclohexanedicarboxylic acid, 1,4-bis(carboxymethyl) cycolhexane and 1,4-bis(2-carboxyethyl)cyclohexane are mentioned. 1,4-cyclohexanedicarboxylic acid is more preferable.

As a monomer (hereinafter referred to as noncrystalline monomer) other than the aforementioned crystalline monomers which can constitute the crystalline polyester resin, the hereinafter mentioned divalent or higher polyvalent noncrystalline alcohol components and noncrystalline carboxylic acids can be employed.

As the divalent noncrystalline alcohol component, the following compounds are exemplified: bisphenol A-alkylene oxide adducts, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis (4-hydroxyphenyl)propane, 1,2-propanediol, neopentyl glycol, 1,4-butenediol, bisphenol A, hydrogenated bisphenol A and the like.

As the trivalent or higher polyvalent noncrystalline alcohol component, the following compounds are exemplified: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2, 4-butanetriol, trimethylolethane, trimethylolpropane, 1,3,5-trihydroxymethylbenzene and the like.

As the divalent noncrystalline carboxylic acid component, the following compounds are exemplified: maleic acid, fumaric acid, citraconic acid, itaconic acid, glutaconic acid, phthalic acid, isophthalic acid, terephthalic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, anhydrides or lower alkyl esters of these acids and the like.

As the trivalent or higher polyvalent noncrystalline carboxylic acid component, the following compounds are exemplified: 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides or lower alkyl esters of these acids and the like.

Although a blending amount of the aforementioned crystalline polyester resin is not specifically restricted in so far as the toner according to the present invention can be obtained, said blending amount is usually not less than 10% by weight, preferably not less than 30% by weight based on the total amount of the binding resin.

The noncrystalline polyester resin can be obtained by polymerizing the carboxylic acid component and alcohol component which comprise no crystalline monomer (i.e. the aforementioned divalent or higher polyvalent noncrystalline carboxylic acid component and noncrystalline alcohol component) according to a publicly known method.

From a viewpoint of not causing a decrease of the elasticity at higher temperature, it is preferable that the noncrystalline polyester resin has a crosslinked structure, which means that said polyester resin has a three-dimensional network structure wherein two or more linear chain polymers are chemically linked between the specified atoms (crosslinking points). The noncrystalline polyester resin having such a crosslinked structure can be obtained by employing at least the following components as a monomer among the aforementioned divalent or higher polyvalent noncrystalline carboxylic acid components and noncrystalline alcohol components: trivalent or higher polyvalent noncrystalline carboxylic acid components and/or noncrystalline alcohol components, and/or divalent or higher polyvalent noncrystalline carboxylic acid components and/or noncrystalline alcohol components having a polymerizable double bond. A desirable total amount of the noncrystalline carboxylic acid components and the noncrystalline alcohol components which play a role as a crosslinking agent is 10–60 mol %, preferably 30–45 mol % based on the total amount of the monomers which constitute the noncrystalline polyester resin.

From a viewpoint of the environmental factor, it is preferable to adjust an acid value of the noncrystalline polyester resin to 0–35 KOHmg/g, preferably 0–15 KOHmg/g.

From viewpoints of heat resistance and fixability, it is desirable that a glass transition point (Tg) and a softening point (Tm) of the crystalline resin are 50–70° C. (preferably 55–65° C.) and 80–150° C. (preferably 90–120° C.) respectively.

From viewpoints of an increase of heat resistance and an undeterioration of elasticity of the crystalline resin, it is desirable that Tg and Tm of the noncrystalline resin are 50–70° C. (preferably 55–65° C.) and 110–150° C. (preferably 120–140° C.) respectively.

The values of Tg, Tm, Mn and Mw/Mn of the noncrystalline resin described in the present specification are those measured by using the components of the noncrystalline resin which are dissolved in tetrahydrofuran.

In the present invention, the viscoelasticity of the aforementioned toner can be controlled by adjusting the compositions, Tg, Tm and Mw/Mn of the crystalline resin and noncrystalline resin. For example, it is possible to make $G'^{140}$ high by using a large amount of the crystalline monomer for the crystalline resin and a small amount of the crosslinking agent for the noncrystalline resin. In this case, $G'_{140}$ increases remarkably when Mw/Mn becomes lower. It is possible to make $G'_{90}$ low by decreasing Tg of the crystalline resin and/or noncrystalline resin.

Furthermore, it is possible to make $G'_{90}$ high by increasing Tg of the crystalline resin. When Tm is increased by an addition of the crosslinking agent, the crystallinity is apt to deteriorate. It is possible to shift the maximum of δ to higher temperature side by increasing Mw of the crystalline resin and/or noncrystalline resin. It is possible to increase the maximum of δ by decreasing Mw/Mn of the crystalline resin and/or noncrystalline resin.

The publicly known pigments and dyes may be employed as a colorant. The following pigments and dyes are exemplified: various kinds carbon blacks, active carbon, titanium black, aniline blue, chalcoyl blue, chrome yellow, ultramarine blue, Du Point oil red, quinoline yellow, methylene blue chloride, copper phthalocyanine blue, malachite green oxalate, lamp black, rose bengal, C.I. pigment red 48:1, C.I. pigment red 57:1, C.I. pigment red 122, C.I. pigment red 184, C.I. pigment yellow 12, C.I. pigment yellow 17, C.I. pigment yellow 97, C.I. pigment yellow 109, C.I. pigment yellow 110, C.I. pigment yellow 155, C.I. pigment yellow 180, C.I. pigment yellow 185, C.I. solvent yellow 162, C.I. pigment blue 15:1, C.I. pigment blue 15:3, and the like. A suitable amount of addition of the colorant is 2–10 parts by weight relative to 100 parts by weight of the binder resin.

In the case of black toner, a magnetic material can be substituted for a part or the whole of the colorant. Fine particles of the publicly known magnetic materials such as ferrite, magnetite, iron and the like can be used as such a magnetic material. The preferable mean particle size of the magnetic particles is not more than 1 μm, particularly not more than 0.5 μm from a viewpoint of their dispersibility at the time of preparing the black toner. In the case where the magnetic particles are added from viewpoints of a prevention of scattering and the like while the characteristics as a nonmagnetic toner are maintained, a desirable amount of addition of the magnetic particles is 0.5–10 parts by weight, preferably 0.5–8 parts by weight, more preferably 1–5 parts by weight relative to 100 parts by weight of the binder resin. When said amount exceeds 10 parts by weight, a developability is decreased since a magnetic restraining force against the toner of a developer-supporting member with a built-in magnet roller becomes stronger.

In the present invention, it is preferable to use the colorant and magnetic material as a master batch from a viewpoint of an increase of their dispersibility in the binder resin, said master batch being prepared by previously mixing them with the binder resin to be used and then kneading the mixture in a molten state. A blending amount of the master batch is determined in such a way that a ratio of the colorant to the binder resin is fallen within the aforesaid range.

Although the publicly known materials which have been used as a charge-control agent for toner can be employed as the charge-control agent in the present invention, it is preferable to employ the colorless, white or light-colored charge-control agents for color toners which do not give adverse effects on the tone and light-transmitting properties of the color toner. Examples thereof include metal complexes of zinc and chromium of salicylic acid derivatives, calix arene compounds, organic boron compounds, quaternary ammonium salt compounds containing fluoride, etc. With respect to the metal complex of salicylic acid derivative, for example, those disclosed in U.S. Pat. No. 4,206,064, U.S. Pat. No. 4,762,763 etc. may be adopted. With respect to calix arene compounds, for example, those disclosed in U.S. Pat. No. 5,049,467 etc. may be adopted. With respect to organic boron compounds, for example, those disclosed in U.S. Pat. No. 5,863,692, etc. may be adopted.

As the release agent, the publicly known materials which have been used as a release agent for toners can be employed. The following release agents are exemplified: polyethylene wax, oxidation-type polyethylene wax, polypropylene wax, oxidation-type polypropylene wax, ester wax, carnauba wax, sasol wax, rice wax, candelilla wax, hohoba oil wax, beeswax and the like. Among the aforesaid release agents, it is preferable to employ two or more kinds of waxes having different melting points, particularly a mixture of a wax having a melting point of 60–120° C. and a wax having a melting point of 120–150° C., more preferably a mixture of polypropylene wax having a melting point of 130–140° C. and a low-melting wax having a melting point of 80–120° C. from the viewpoints of the releasability and scratch for a fixing roller, the smear-preventive property and the like. A suitable blending amount of the release agent is 2–10 parts by weight relative to 100 parts by weight of the binder resin. In the case where two or more release agents are employed, said blending amount is controlled such that a total amount of the release agents is fallen with the aforesaid range.

The toner according to the present invention can be obtained by, for example, the following procedure: (i) the aforementioned materials for toner are mixed by means of a mixing equipment such as Henschel mixer and the like, (ii) the mixture is kneaded in a molten state by means of twin-screw extruding kneader, (iii) the kneaded mixture is pulverized coarsely and finely, and if necessary, (iv) the finely pulverized toner is classified, and then (v) an external additive is added to the toner. It is preferable to adjust a volume-average particle size of the toner to 5–9 $\mu$m.

A fluidity and a cleanability of the toner can be increased by adding the external additive to the toner. The external additives are not specifically restricted in so far as they are the materials which have been employed as an external additive in the field of toners. For example, the following additives may be employed: inorganic oxide fine particles (e.g., silica fine particles, alumina fine particles, titanium fine particles and the like), fine particles of metallic salts of stearic acid (e.g., aluminum stearate fine particles, zinc stearate fine particles and the like) and inorganic titanate fine particles (e.g., strontium titanate fine particles, zinc titanate fine particle and the like). These additives can be used independently or jointly. From the viewpoints of the environmental stability and the maintenance of heat resistance, it is desirable to use these fine particles after their surfaces are treated with a silane coupling agent, a titanium coupling agent, a higher fatty acid, a silicone oil and the like. An adding amount of these fine particles is 0.05–5 parts by weight, preferably 0.1–3 parts by weight relative to 100 parts by weight of the toner. Two or more external additives may be employed. In such a case, their amounts to be added are adjusted such that a total amount thereof is fallen within the aforesaid range.

The aforementioned toner according to the present invention can effectively prevent the low temperature offset and high temperature offset and can provide an image having excellent light transmission for OHP with a favorable fixing efficiency (running cost) when said toner is applied to the fixing device whose coating weight of an oil is reduced to not more than $8\times10^{-4}$ mg/cm$^2$, preferably an oilless fixing device. Accordingly, the toner according to the present invention is advantageous to a case wherein a small-sized and low-priced copying machine or printer is designed.

The aforesaid fixing device to which the toner of the present invention can effectively applied is a device which adopts a publicly known heat-contact bonding method wherein heat and pressure are applied at the time of fixing. The coating weight of an oil is measured as follows. Namely, when a paper (typically a copying paper "CF paper" which is available from Minolta Co., Ltd.) which is used in a common copying machine is passed through a fixing member whose surface is coated with an oil, the oil is adhered on the paper. The adhered oil on the paper is extracted by means of Soxhlet extractor. Hexane is employed as a solvent. An amount of the oil adhered on the paper can quantitatively determined by measuring the amount of the oil contained in hexane by means of atomic absorption analyzer. The coating weight of the oil can be obtained by dividing the measured value by an area of the paper. When the obtained coating weight of the oil exceeds $8\times10^{-4}$ mg/cm$^2$, the following problems will occur: (i) an image quality is decreased because of an oil which remains on an image surface after fixing, (ii) a light transmission is remarkably decreased in the case of OHP in particular wherein a transmitted light is utilized, and (iii) an oiliness occurs since the oil is adhered to the member to be transferred. Furthermore, when the coating weight of the oil becomes larger, there is a problem that the fixing device becomes large-sized since a capacity of a tank for storing the oil becomes large.

Although the oil to be coated on the fixing member is not specifically restricted, heat-resistant oils, for example, an oil for preventing offset, such as dimethyl silicone oil, fluorine oil, fluorosilicone oil and amino-modified silicone oil are exemplified as said oil to be coated. In the case where the toner of the present invention is employed, expensive fluorine oil and fluorosilicone oil can be employed since the coating weight of the oil is, as stated above, an extremely small amount.

In addition, the toner of the present invention has a relatively broad fixing temperature range (the fixing temperature region wherein the low temperature offset and high temperature offset do not occur) with a relatively low temperature level. To say more precisely, the fixing temperature range of the toner according to the present invention is not less than 40° C., preferably not less than 50° C., and its temperature level (especially a lower limit of the fixing temperature range) is not more than 135° C., preferably not more than 130° C. in the case where said toner is applied to the oilless fixing device or is not more than 120° C., preferably not more than 115° C., more preferably not more than 110° C. in the case where said toner is applied to the fixing device whose coating weight of the oil is $8.0\times10^{-4}$ mg/cm$^2$. When the fixing temperature range is too high in the case in particular where an image formation is successively carried out two or more times, a phenomenon is apt to occur, in which the fixing is not sufficiently carried out on and after the second image formation, and the copied image is easy to exfoliate because a temperature of the fixing member (fixing temperature) is decreased by a repeating contact of the member to be transferred with the fixing member at the time of fixing (the low temperature offset). When the fixing temperature range is on a relatively high temperature level, the running cost becomes worse since a relatively large energy is required for the fixing.

Although the present invention will be more concretely illustrated by the following examples hereinafter, the present invention is not restricted to these examples.

EXAMPLES

Preparation of PES1–PES9

The monomers shown in Table 1 were weighed in such a way that their molar ratio became the values shown in said table, and these monomers were charged into a four-knecked flask (2 L), and then a reflux condenser, a water separator, a nitrogen gas inlet pipe, a thermometer and a agitator were installed to said flask. The monomer mixture was heated on a mantle heater under agitation in order to carry out a reaction, while nitrogen gas was introduced into said flask. The reaction temperature was 180–240° C. The reaction state was followed by measuring an acid value of the reaction mixture in the course of reaction. The polyester resins were obtained by stopping the reaction when the acid value reached the prescribed value.

In the case where two or more resins were employed in the examples and comparative examples, said resins were previously dryblended by means of Henschel mixer and then used.

TABLE 1

| | | Composition of monomers | | | | | | | | | | |
|---|---|---|---|---|---|---|---|---|---|---|---|---|
| | | | | | | | | Alcohol monomer | | | | |
| | | Acid monomer | | | | | | BPA- | BPA- | | | |
| Resin | | TPA | IPA | CHDA | DSA | TMA | FA | PO | EO | EG | CHDM | TMP |
| PES1 | Crystalline | 100 | — | — | — | — | — | — | 30 | 65 | — | 5 |
| PES2 | Crystaliine | 100 | — | — | — | — | — | — | 30 | 70 | — | — |
| PES3 | Crystalline | 100 | — | — | — | — | — | — | 45 | — | 45 | 10 |
| PES4 | Crystalline | 35 | 45 | 20 | — | 5 | — | — | — | — | 40 | — |
| PES5 | Crystalline | 100 | — | — | 20 | — | — | — | 70 | 30 | — | — |
| PES6 | Crystalline | 100 | — | — | — | — | — | — | 50 | — | 45 | 5 |
| PES7 | Crystalline | 100 | — | — | — | 10 | — | — | 15 | 80 | — | 5 |
| PES8 | Noncrystalline | 40 | — | — | 40 | 50 | 0 | 70 | 30 | — | — | — |
| PES9 | Noncrystalline | 50 | — | — | — | — | 50 | 70 | 40 | — | — | — |

The meanings of the abbreviations used in Table 1 are as follows:

-: not used
TPA: terephthalic acid
IPA: isophthalic acid
CHDA: 1,4-cyclohexanedicarboxylic acid
DSA: dodecenylsuccinic acid
TMA: trimellitic acid
FA: fumaric acid
BPA-PO: bisphenol A-propylene oxide (2 mol) adduct
BPA-EO: bisphenol A-ethylene oxide (2 mol) adduct
EG: ethylene glycol
CHDM: cyclohexanedimethanol
TMP: trimethylolpropane

TABLE 2

| Resin | Tg (° C.) | Tm (° C.) | Mn | Mw | Acid value (KOHmg/g) |
|---|---|---|---|---|---|
| PES1 | 61 | 98 | 3800 | 8900 | 15 |
| PES2 | 61 | 95 | 3200 | 6100 | 12 |
| PES3 | 62 | 118 | 3600 | 10000 | 12 |
| PES4 | 62 | 103 | 4500 | 9300 | 17 |
| PES5 | 59 | 117 | 3200 | 39000 | 21 |
| PE56 | 62 | 102 | 3000 | 7900 | 14 |
| PES7 | 62 | 115 | 3800 | 710000 | 16 |
| PES8 | 61 | 134 | 2600 | 17000 | 27 |
| PES9 | 60 | 96 | 4400 | 12000 | 6 |

Preparation of a Pigment Master Batch

A binder resin employed in each example and comparative example and C.I. pigment blue 15:3 (available from Toyo Ink Seizo Inc.) were charged into a pressure kneader in a weight ratio of 7:3 (resin:pigment) and kneaded at 120° C. for one hour. The kneaded mixture was cooled, and then coarsely pulverized by means of a feather mill to obtain a pigment master batch.

Example 1

The pigment master batch (10 parts by weight), the binder resin (PES1)(93 parts by weight), polypropylene wax having high melting point (100-TS which is available from Mitsui Kasei Kogyo Inc.; 2 parts by weight) and polyethylene wax having low melting point (800P which is available from Mitsui Kagaku Inc.; 0.5 parts by weight) were mixed by means of Henschel mixer, and the mixture was kneaded by means of a twin screw extruding kneader. The kneaded mixture was cooled, and then coarsely pulverized by means of a feather mill. The coarsely pulverized mixture was finely pulverized by means of a jet mill. The finely pulverized mixture was classified to obtain the toner particles having a mean particle size of 6 $\mu$m. Silica (H2000 which is available from Clariant Japan Inc.; 1.0 part by weight) wad added to the toner particles (100 parts by weight), and the mixture was treated by means of Henschel mixer to obtain the toner of the present invention.

Examples 2–6 and Comparative Examples 1–7

The toners according to these examples and comparative examples was obtained by the same preparation method as that in Example 1except that the binder resins shown in Table 3 were employed and the pigment master batches prepared by using said binder resins were employed.

The viscoelasticity characteristics ($G'_{90}$, $G'_{140}$ and a graph of δ (ordinate axis)—temperature (abscissa axis)) of the toners obtained in each example and comparative example were measured by means of an apparatus for measuring a viscoelasticity (stress-controlling type rheometer manufactured by Rheologica Inc.). The graph of δ (ordinate axis)—temperature (abscissa axis) concerning the toner obtained in Example 1 is shown in FIG. 1.

TABLE 3

| | Binder resin | | | | | | | | Maximum value of δ at 90~120° C.) | |
|---|---|---|---|---|---|---|---|---|---|---|
| | Kind | Resin | wt %* | Kind | Resin | wt %* | $G'_{90}$ | $G'_{140}$ | Temperature at which maximum value is observed (° C.) | Maximum value (°) |
| Ex. 1 | Crystalline | PES1 | 100 | — | — | — | $5.5 \times 10^4$ | $5.6 \times 10^3$ | 99 | 76 |
| Ex. 2 | Crystalline | PES2 | 100 | — | — | — | $2.5 \times 10^4$ | $2.2 \times 10^5$ | 98.3 | 78 |
| Ex. 3 | Crystalline | PES2 | 50 | Noncrystalline | PES8 | 50 | $4.5 \times 10^4$ | $1.0 \times 10^4$ | 98.6 | 72 |
| Ex. 4 | Crystalline | PES1 | 50 | Noncrystalline | PES8 | 50 | $5.6 \times 10^4$ | $7.1 \times 10^2$ | 98.6 | 64 |
| Ex. 5 | Crystalline | PES1 | 75 | Noncrystalline | PES8 | 25 | $5.3 \times 10^4$ | $8.6 \times 10^2$ | 98.8 | 67 |
| Ex. 6 | Crystalline | PES1 | 15 | Noncrystalline | PES8 | 85 | $5.9 \times 10^4$ | $6.2 \times 10^2$ | 98.2 | 61 |
| Com. Ex. 1 | — | — | — | Noncrystalline | PES8 | 100 | $8.3 \times 10^4$ | $3.6 \times 10^3$ | 78.5 | 61 |
| Com. Ex. 2 | — | — | — | Noncrystalline | PES9 | 100 | $1.3 \times 10^4$ | $2.0 \times 10^1$ | 110.2 | 86 |
| Com. Ex. 3 | Crystalline | PES3 | 100 | — | — | — | $2.1 \times 10^6$ | $7.7 \times 10^5$ | 99.6 | 32 |
| Com. Ex. 4 | Crystalline | PES4 | 100 | — | — | — | $5.3 \times 10^4$ | $2.1 \times 10^2$ | 109.6 | 85 |
| Com. Ex. 5 | Crystalline | PES5 | 100 | — | — | — | $8.4 \times 10^4$ | $6.7 \times 10^2$ | ** | ** |
| Com. Ex. 6 | Crystalline | PES6 | 100 | — | — | — | $1.5 \times 10^5$ | $1.7 \times 10^3$ | 96.0 | 57 |
| Com. Ex. 7 | Crystalline | PES7 | 100 | — | — | — | $2.7 \times 10^5$ | $4.6 \times 10^2$ | 125 | 65 |

*A percentage in relation to the total weight of the binder resin.
**A maximum value was not observed.

Evaluation

A developer obtained by mixing each toner and the aftermentioned carrier (toner mixing ratio: 6% by weight) was loaded into a full-color copying machine (CF900 manufactured by Minolta Co., Ltd.) having the following system construction, and then evaluated.

Recording medium: CF paper

Adhesion amount of the toner: 12 g/m$^2$

Fixing device: Any of the following systems 1 and 2 can be employed.

(i) System 1 whose coating weight of the oil is adjusted to 0 mg/cm$^2$ (heat-contact bonding type fixing device in which a surface of the fixing member comprises a fluorine resin).

(ii) System 2 whose coating weight of the oil is adjusted to $8.0 \times 10^{-4}$ mg/cm$^2$.

The aforesaid adhesion amount of the toner means an adhesion amount of the toner when a solid image is copied, and said adhesion amount is a value calculated from an area of aspirated image and a weight of aspirated toner when an unfixed toner is subjected to an air-aspiration.

The fixing temperature range wherein any of the low temperature offset and high temperature offset does not occur was determined by copying the solid image while the fixing temperature is changed. The results were ranked according to the following standard, said results including a lower limit of the fixing temperature:

"◎": The fixing temperature range was not less than 50° C.

"○": The fixing temperature range was not less than 40° C. and not more than 50° C. There was no practical problem.

"x": The fixing temperature range was not more than 40° C. There was a practical problem.

The lower limit of the fixing temperature and the upper limit of the fixing temperature were determined by the following methods.

(i) The Lower Limit of the Fixing Temperature

The obtained solid image was bent at its middle part, and a peelability of the image was evaluated by a visual observation. The lower limit of the fixing temperature was a temperature between a fixing temperature wherein the image was peeled and a lower limit of fixing temperature wherein the image was not peeled.

(ii) The Upper Limit of the Fixing Temperature

A blank sheet of paper was passed through the copying machine after the solid image was copied, and the high temperature offset on said blank sheet was evaluated by a visual observation. The upper limit of the fixing temperature was a temperature between a fixing temperature wherein the high temperature offset occurred and an upper limit of fixing temperature wherein the high temperature offset did not occur.

The light transmission in OHP was determined by the following method. After a graduation image whose maximum adhesion amount of the toner was 4 g/m$^2$ was inputted, the light transmission was visually evaluated by means of a projection for OHP. A sheet for OHP which is exclusively employed for full-color (commercially available from Minolta Co., Ltd.) was used as a recording medium. The results shown in Table 4 were ranked according to the following standard:

"◎": Light was thoroughly transmitted.

"○": Light was transmitted.

"x": Light was not transmitted.

TABLE 4

| | Fixing temperature range | | Lower limit of fixing temperature | | Light transmission |
|---|---|---|---|---|---|
| | System 1 | System 2 | System 1 | System 2 | for OHP |
| Ex. 1 | ○ | ◎ | 125 | 110 | ◎ |
| Ex. 2 | ◎ | ◎ | 119 | 106 | ○ |
| Ex. 3 | ◎ | ◎ | 121 | 108 | ○ |
| Ex. 4 | ○ | ◎ | 127 | 111 | ◎ |
| Ex. 5 | ○ | ◎ | 125 | 111 | ○ |
| Ex. 6 | ○ | ○ | 129 | 113 | ○ |
| Com. Ex. 1 | ○ | ○ | 139 | 132 | x |

TABLE 4-continued

| | Fixing temperature range | | Lower limit of fixing temperature | | Light transmission |
|---|---|---|---|---|---|
| | System 1 | System 2 | System 1 | System 2 | for OHP |
| Com. Ex. 2 | x | x | 113 | 102 | ⊙ |
| Com. Ex. 3 | ○ | ○ | 151 | 153 | x |
| Com. Ex. 4 | x | x | 123 | 111 | ⊙ |
| Com. Ex. 5 | ○ | x | 139 | 132 | x |
| Com. Ex. 6 | ○ | ○ | 143 | 136 | x |
| Com. Ex. 7 | x | x | 145 | 140 | ○ |

Preparation of a Coated Carrier

Methyl ethyl ketone (100 parts by weight) was charged in a flask (500 ml) equipped with agitator, condenser, thermometer, tube for introducing nitrogen and dropping device. On the other hand, a solution was prepared at 80° C. under nitrogen atmosphere by dissolving methyl methacrylate (36.7 parts by weight), 2-hydroxy ethyl methacrylate (5.1 parts by weight), 3-methacryloxypropyl tris (trimethylsiloxy)silane (58.2 parts by weight) and 1,1'-azobis(cyclohexane-1-carbonitrile) (1 part by weight) in methyl ethyl ketone (100 parts by weight). The solution was dripped into the flask over 2 hours, and the reaction mixture was aged at 80° C. for 5 hours.

Isophorone diisocyanate/trimethylolpropan adduct (IPDI/TMP:NCO %=6.1%) was added as a crosslinking agent to the obtained resin in such a way that a molar ratio of OH/NCO becomes 1/1, and the mixture was diluted with methyl ethyl ketone to prepare a coating resinous solution (solid content: 3% by weight).

Calcined ferrite powder F-300 (volume average particle size: 50 μm; Powder Tec Co.) which is a core material was coated with the aforesaid coating resinous solution by means of Spira Coater (Okada Seiko Co.) in such a way that a coating amount of the resin becomes 1.5% by weight, and the coated ferrite powder was dried to obtain the carrier.

The obtained carrier was left in a circulating hot air oven (160° C.) for 1 hour to calcine the carrier. After cooling, the ferrite powder bulk was pulverized by means of a vibrating shifter equipped with screen meshes having sieve opening of 106 μm and 75 μm to obtain the coated carrier.

Measuring Methods

The values obtained by the following method are used as the glass transition point (Tg) of the resin in the present specification. Said values were measured by means of a differential scanning calorimeter (DSC-200 manufactured by Seiko Denshi Inc.) in which a precisely weighed sample to be measured (10 mg) held in an aluminum pan was heated from room temperature to 200° C. at a heating rate of 30° C./min, and cooled, and then heated from 30° C. to 120° C. at a heating rate of 10° C./min. α-alumina held in an aluminum pan was used as a reference. The shoulder value of the main endothermic peak appeared in 30–90° C. during the latter heating process was defined as Tg.

The values obtained by the following method are used as the softening point (Tm) of the resin in the present specification. Said values were measured by means of a flow tester (CFT-500 manufactured by Shimazu Seisakusho Inc.) equipped with a die (height: 1.0 mm, diameter: 1.0 mm) in which a weighed sample to be measured (1.0 g) was preheated for 180 seconds and then heated from 50° C. to 160° C. at a heating rate of 3.0° C./min under a load of 30 kg. A temperature at which half of the sample was flown out was defined as Tm.

The values measured by means of a gel permeation chromatography (GPC)(830-RI type manufactured by Nihon Bunko Kogyo Inc.) are used as the number-average molecular weight (Mn) and weight-average molecular weight (Mw) in the present specification. To say more precisely, a sample to be measured (30 mg) was dissolved in tetrahydrofuran (5 ml), and said solution (100 μl) was injected into a column (40° C.) together with a carrier solvent (tetrahydrofuran; 1 ml/min), and these molecular weight values were determined by polystyrene conversion method.

The values obtained by the following method are used as the acid value in the present specification. A sample (10 mg) was dissolved in toluene (50 ml), and the solution was titrated with a previously standardized alcoholic solution of potassium hydroxide (1/10N) in the presence of a mixed indicator (0.1% bromthymol blue and phenol red). The acid value was calculated from a consumption amount of said alcoholic solution.

The toner of the present invention can effectively prevent the low temperature offset and the high temperature offset and can provide an image having excellent fixing efficiency and light transmission for OHP even when it is applied to the fixing device whose coating weight of the oil is reduced. The toner of the present invention has a relatively wide and low temperature range which does not bring about the low temperature offset and the high temperature offset.

What is claimed is:

1. A color toner characterized in that (i) it comprises a binding resin and a colorant, (ii) its storage elastic modulus at 90° C. ($G'_{90}$) is not more than $6\times10^4$ Pa, (iii) its storage elastic modulus at 140° C. ($G'_{140}$) is not less than $5\times10^2$ Pa, (iv) a temperature showing a maximum value of δ in tanδ=G"/G' (wherein G' is a storage elastic modulus of the color toner, and G" is a loss elastic modulus of the color toner) exists in the range of 90–110° C., and (v) the maximum value of δ is not less than 60° and not more than 90°.

2. A color toner of claim 1, wherein $G'_{90}$ is $3\times10^4$–$6\times10^4$ Pa, and $G'_{140}$ is $5\times10^2$–$1\times10^5$ Pa.

3. A color toner of claim 1, wherein $G'_{90}$ is $4\times10^4$–$6\times10^4$ Pa, and $G'_{140}$ is $5\times10^2$–$1\times10^4$ Pa.

4. A color toner of claim 1, wherein $G'_{90}$ is $5\times10^4$–$6\times10^4$ Pa, and $G'_{140}$ is $5\times10^2$–$1\times10^3$ Pa.

5. A color toner of claim 1, wherein the maximum value of δ is 60–85°.

6. A color toner of claim 1, wherein the temperature showing the maximum value of δ exists in the range of 90–105° C., and said value is 60–80°.

7. A color toner of claim 1, wherein the binding resin comprises a crystalline resin, and a content of the crystalline resin is not less than 30% by weight based on an amount of the binding resin.

8. A color toner of claim 1, wherein it comprises a releasant, and a content of the releasant is 2–10 parts by weight in relation to 100 parts by weight of the binding resin.

9. A color toner of claim 8, wherein the releasant comprises a first wax having a melting point of 60–120° C. and a second wax having a melting point of 120–150° C.

10. A color toner of claim 9, wherein the melting point of the first wax is 80–120° C., and the melting point of the second wax is 130–140° C.

11. A color toner characterized in that (i) it comprises a binding resin and a colorant, (ii) its storage elastic modulus at 90° C. ($G'_{90}$) is not more than $6\times10^4$ Pa, (iii) its storage elastic modulus at 140° C. ($G'_{140}$) is not less than $5\times10^2$ Pa, (iv) a temperature showing a maximum value of δ in tan δ=G"/G' (wherein G' is a storage elastic modulus of the color toner, and G" is a loss elastic modulus of the color toner) exists in the range of 90–120° C., and (v) the maximum value of δ is not less than 60°, wherein the binding resin comprises crystalline polyester resin and noncrystalline polyester resin.

12. A color toner of claim 11, wherein the crystalline polyester resin has an acid number of 0–35 KOHmg/g, and the noncrystalline polyester resin has an acid number of 0–35 KOHmg/g.

13. A color toner of claim 11, wherein the noncrystalline polyester resin has a crosslinked structure.

14. A color toner of claim 11, wherein the crystalline polyester resin has a glass transition point of 55–65° C. and a softening point of 80–150° C., and the noncrystalline polyester resin has a glass transition point of 50–70° C. and a softening point of 110–150° C.

15. A color toner for an oilless fixing characterized in that (i) it comprises a binding resin, a colorant and a releasant, (ii) its storage elastic modulus at 90° C. ($G'_{90}$) is not more than $6\times10^4$ Pa, (iii) its storage elastic modulus at 140° C. ($G'_{140}$) is not less than $5\times10^2$ Pa, (iv) a temperature showing a maximum value of δ in tanδ=G"/G' (wherein G' is a storage elastic modulus of the color toner, and G" is a loss elastic modulus of the color toner) exists in the range of 90–120° C., and (v) the maximum value of δ is not less than 60°, the releasant comprising a first wax having a melting point of 60–120° C. and a second wax having a melting point of 120–150° C.

16. A color toner of claim 15, wherein $G'_{90}$ is $3\times10^4$–$6\times10^4$ Pa, and $G'_{140}$ is $5\times10^2$–$1\times10^5$ Pa, the maximum value of δ exists in the range of 90–120° C., and said value is not less than 60° and less than 90°.

17. A color toner of claim 15, wherein $G'_{90}$ is $4\times10^4$–$6\times10^4$ Pa, and $G'_{140}$ is $5\times10^2$–$1\times10^4$ Pa, the temperature showing the maximum value of δ exists in the range of 90–110° C., and said value is 60–85°.

18. A color toner of claim 15, wherein the binding resin comprises a crystalline polyester resin and a noncrystalline polyester resin.

19. A color toner of claim 15, wherein the melting point of the first wax is 80–120° C., and the melting point of the second wax is 130–140° C.

* * * * *